US012782079B2

(12) United States Patent
Hansen

(10) Patent No.: US 12,782,079 B2
(45) Date of Patent: Nov. 3, 2026

(54) AXLE ASSEMBLY FOR A BOW

(71) Applicant: Precision Shooting Equipment, LLC., Tucson, AZ (US)

(72) Inventor: Kevin L. Hansen, Jefferson City, MT (US)

(73) Assignee: Precision Shooting Equipment, LLC., Tucson, AZ (US)

( * ) Notice: Subject to any disclaimer, the term of this patent is extended or adjusted under 35 U.S.C. 154(b) by 62 days.

(21) Appl. No.: 18/941,231

(22) Filed: Nov. 8, 2024

(65) Prior Publication Data

US 2026/0133005 A1 May 14, 2026

(51) Int. Cl.
*F41B 5/10* (2006.01)

(52) U.S. Cl.
CPC ..... *F41B 5/105* (2013.01)

(58) Field of Classification Search
CPC ..... F41B 5/10; F41B 5/105
See application file for complete search history.

(56) References Cited

U.S. PATENT DOCUMENTS

| | | | |
|---|---|---|---|
| 9,683,806 | B1 | 6/2017 | Yehle |
| 10,126,087 | B1 | 11/2018 | Grace et al. |
| 11,486,674 | B2 | 11/2022 | Mcpherson |
| 11,536,532 | B1 | 12/2022 | Grace et al. |
| 11,821,708 | B1 | 11/2023 | Hansen et al. |

*Primary Examiner* — Reginald S Tillman, Jr.
(74) *Attorney, Agent, or Firm* — Merchant & Gould P.C.

(57) ABSTRACT

A spacer and axle arrangement for a cam of an archery bow including an axle that extends along an axle axis. The axle including opposite internally threaded ends and defines axle securement openings that extend laterally through the axle. Axle fasteners are adapted to extend through the axle securement openings. Axial end fasteners are adapted to be threaded into the internally threaded ends of the axle in axial alignment with the axle. The axial end fasteners include fastener heads including stop surfaces that face toward the internally threaded ends of the axle. Bearing positioning sleeves slidably mount on the axles. The bearing positioning sleeves have outer ends adapted to be opposed by the stop surfaces of the axial end fasteners. Spacers mount over the bearing positioning sleeves at positions in which the spacers are radially overlapped by the stop surfaces of the axial end fasteners.

20 Claims, 6 Drawing Sheets

AXLE ASSEMBLY FOR A BOW

TECHNICAL FIELD

The present disclosure relates generally to archery equipment. More particularly, the present disclosure relates to axle assemblies for supporting rotatable cams of compound bows.

BACKGROUND

Tuning a compound bow is a process in which the bow is very deliberately and specifically set up to maximize performance. Bow tuning takes into account a number of factors including differences from bow to bow resulting from manufacturing tolerances, the basic bow setup (e.g., draw length) including aftermarket accessories mounted to the bow (arrow rest, stabilizers, sight, etc.) and shooter's shooting variables (shooting technique, type of release used, shooter's physical characteristics (e.g., hand size, facial characteristics such as nose eye alignment, etc.))

One common aspect of tuning a bow includes adjusting the lateral position of a rotatable member such as a cam along the axle that supports the rotatable member. Traditionally, adjusting the lateral position of a rotatable member on its axle is accomplished by adding and removing spacers on either side of the rotatable member. The spacers are typically washer shaped structures that slide over the end of the axle. This tuning process typically involves disassembling the axle assembly, adding and removing spacers onto the axle on either side of the rotatable member and then reassembling the bow. Once reassembled the bow is tested (e.g., paper tuned) and spacers may be further adjusted as needed. This type of bow tuning is iterative, laborious, time intensive and necessitates the use of a specialized equipment. U.S. Pat. No. 11,821,708 discloses a bow axle assembly that provides a more efficient system for adjusting the lateral position of a cam.

SUMMARY

One aspect of the present disclosure relates to a spacer and axle arrangement for mounting a bearing supporting a cam of an archery bow. The spacer and axle arrangement includes an axle that extends along an axle axis. Axial end fasteners are provided for securement to opposite ends of the axle. The axial end fasteners include fastener heads including stop surfaces that face toward the ends of the axle. Bearing positioning sleeves mount on the axles. The bearing positioning sleeves are adjustable axially along the axle axis relative to the axle to adjust a position of the bearing supporting the cam. The bearing positioning sleeves have outer ends opposed by the stop surfaces of the axial end fasteners. Spacers mount over the bearing positioning sleeves. The spacers are configured to be radially overlapped by the stop surfaces of the axial end fasteners. The spacers and the axial end fasteners are accessible at outer sides of limb structures of the bow. The spacers can be interchanged with spacers having different axial thicknesses without requiring the axle to be removed from the limb structures. This allows a lateral positioning of the cam bearing to be adjusted relative to the limb structures without requiring the axle to be removed from the limb structures.

A variety of additional aspects will be set forth in the description that follows. The aspects can relate to individual features and to combinations of features. It is to be understood that both the foregoing general description and the following detailed description are exemplary and explanatory only and are not restrictive of the broad inventive concepts upon which the examples described herein are based.

DETAILED DESCRIPTION

Figure 1:
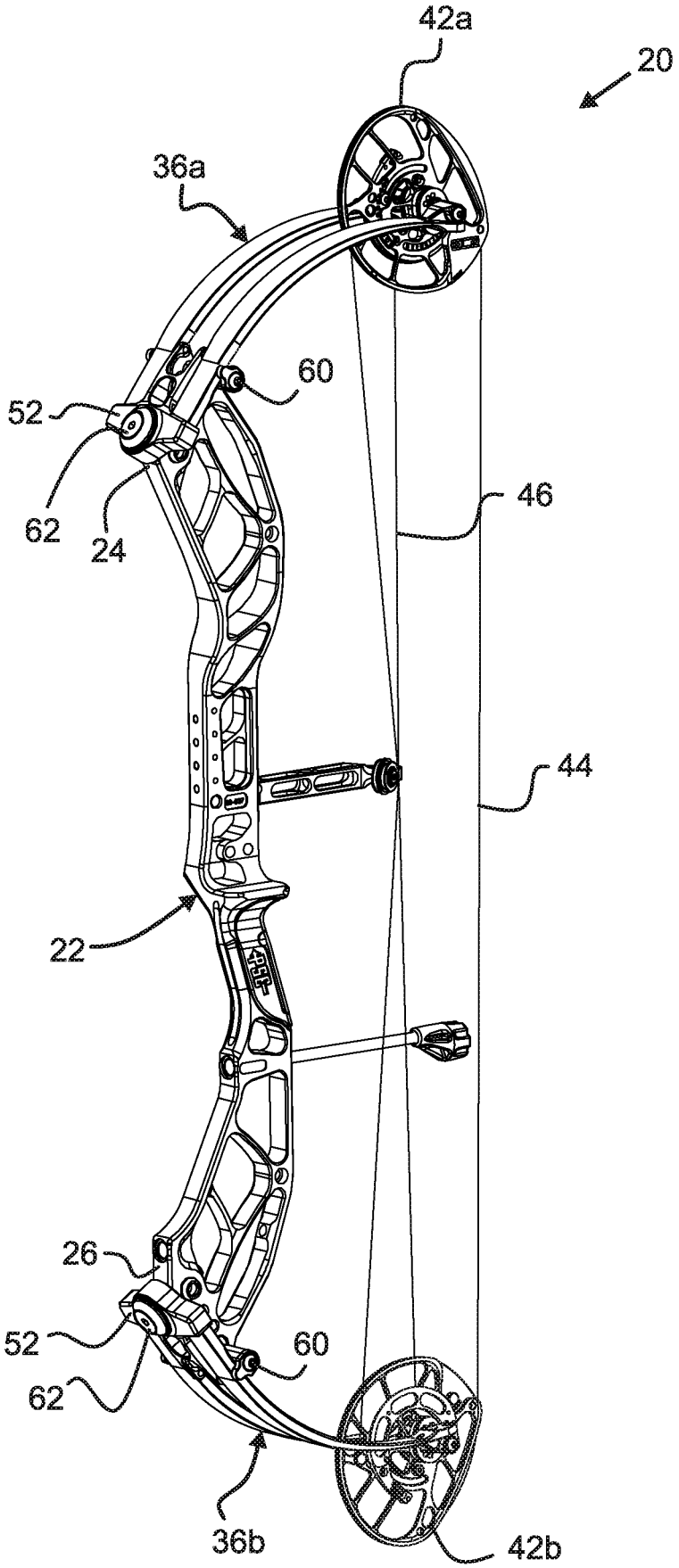
FIG. 1 is a perspective view of an archery bow in accordance with the principles of the present disclosure.

FIG. 1 depicts an archery bow 20 in accordance with the principles of the present disclosure. The bow 20 includes a riser 22 (i.e., a handle) having an upper end 24 and a lower end 26. The bow 20 also includes upper and lower limb arrangements 36*a*, 36*b*. The upper limb arrangement 36*a* attaches to the upper end 24 of the riser 22 and the lower limb arrangement 36*b* attaches to the lower end 26 of the riser 22. The bow 20 further includes an upper cam 42*a* supported by upper limb arrangement 36*a* and a lower cam 42*b* supported by the lower limb arrangement 36*b*. The upper and lower cams 42*a*, 42*b* are configured to engage a bow string 44 and tensioning cables 46.

The bow 20 further includes pivotal limb attachment members such as pivotal limb pockets 52 that mount to the upper and lower ends 24, 26 of the riser 22 for attaching the upper and lower limb arrangements 36*a*, 36*b* to the upper and lower ends 24, 26 of the riser 22. The limb pockets 52 are secured to the riser 22 by laterally oriented pivot axles 60 that allow for pivotal movement of the limb pockets 52 relative to the riser 22 to adjust a draw weight of the bow 20. The pivot axles 60 define pivot axes about which the limb pockets 52 can be pivoted to adjust the draw weight of the bow 20. The bow 20 can further include limb bolts 62 for setting a draw weight of the bow 20 by controlling the pivotal positions of the limb pockets 52 about the pivot axes relative to the riser 22.

The limb arrangements can have various configurations. As depicted, the upper and lower limb arrangements 36*a*, 36*b* each include limb structures such as limb members 70 and pillow blocks 72 that attach to free ends of the limb members 70. The pillow blocks 72 attach to the limb members 70 by block fasteners 73 (e.g., bolts) and posts 74 that fit within corresponding openings 75 defined by the limb members 70. In the depicted example, the pillow blocks 72 define axle openings 76. In alternative examples, the axle openings 76 can be defined directly by the limb members 70. In alternative examples, the limb arrangements can have limb structures having a forked limb configuration. It will be appreciated that axle and cam arrangements corresponding to the upper and lower limb arrangements 36*a*, 36*b* can have the same configuration. Hence, for the sake of brevity, only the axle and cam arrangement of the upper limb arrangement 36*a* will be described. It will be appreciated that this description applies equally to the axle and cam arrangement of the lower limb arrangement 36*b*.

Figure 2:
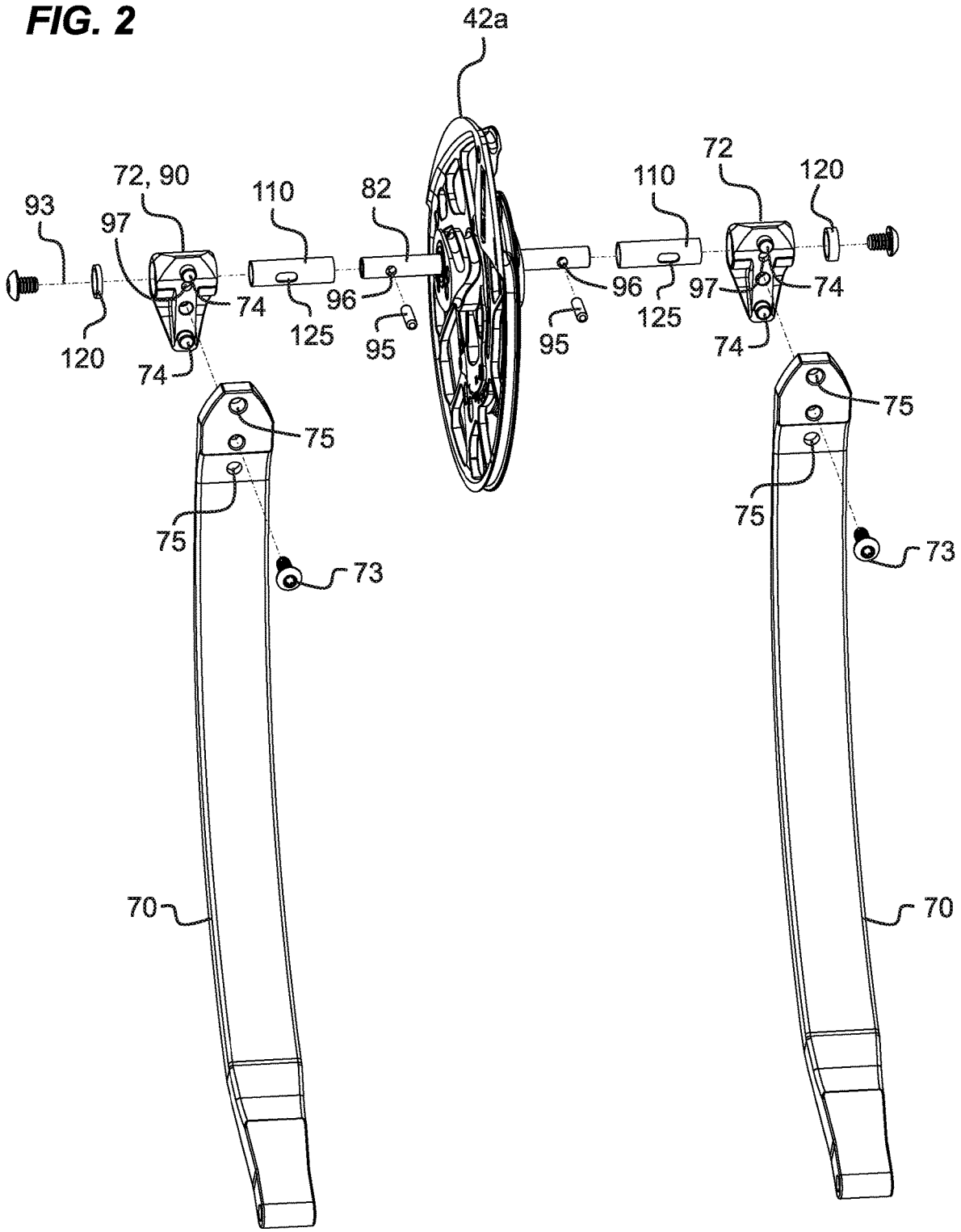
FIG. 2 is an exploded perspective view of an example cam and axle arrangement of the archery bow of FIG. 1.
Figure 3:
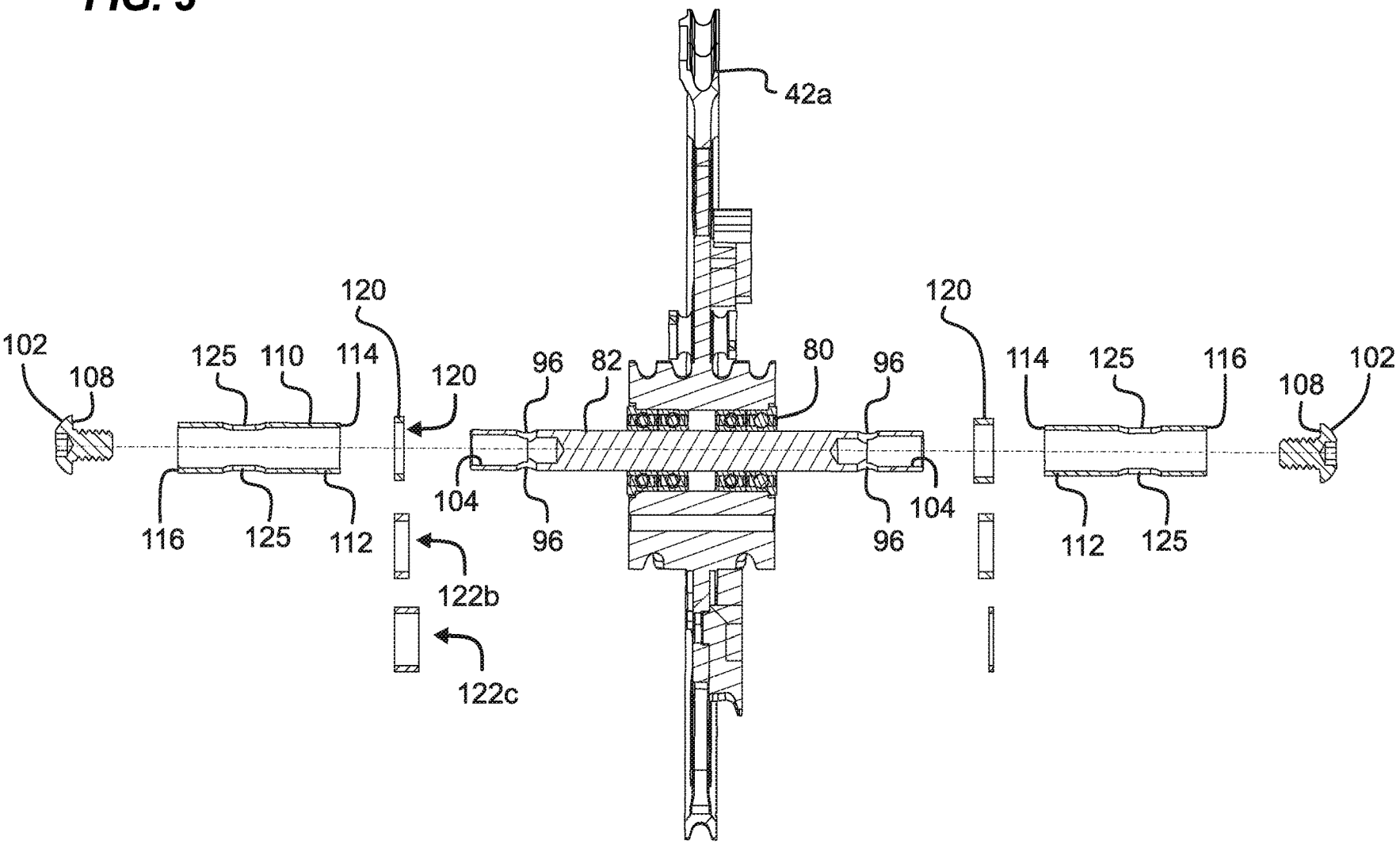
FIG. 3 is an exploded cross-sectional view of the cam and axle arrangement of FIG. 2 with limb structures of a limb arrangement of the archery bow not shown.
Figure 4:
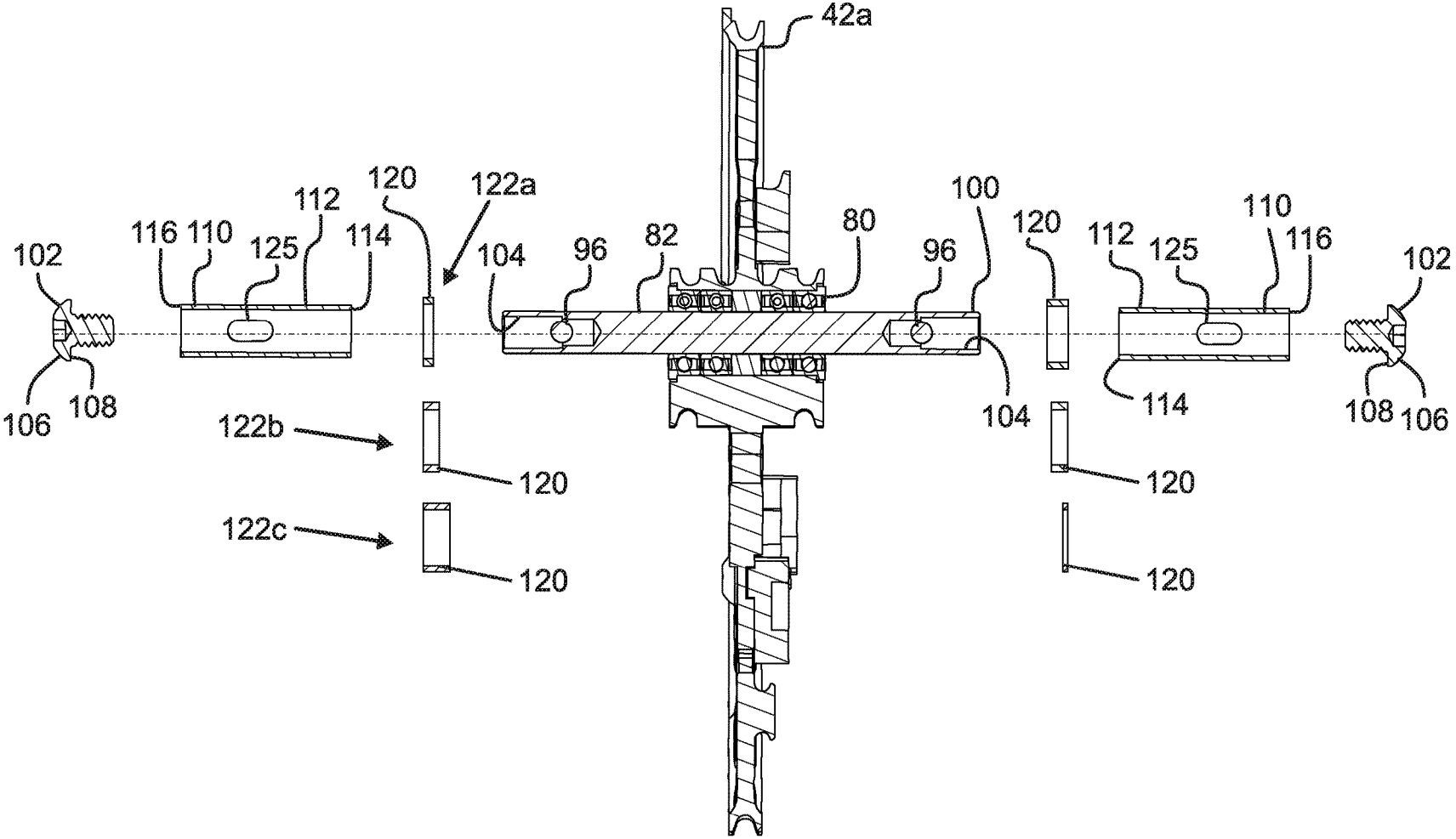
FIG. 4 is another exploded cross-sectional view of the cam and axle arrangement of FIG. 2 with the limb structures of the archery bow not shown.

FIG. 2 depicts an axle arrangement corresponding to the upper cam 42*a*. The upper cam 42*a* is mounted on at least one bearing 80 that mounts on an axle 82. As depicted at FIG. 3, the upper cam 42*a* is mounted on two pairs of bearings 80 installed on the axle 82 with the bearing pairs being separated by a gap 83. In certain examples, another bearing could be used to fill the gap 83. Each of the bearings 80 can include an inner race 84 supported on the axle 82 and an outer race 86 that supports the upper cam 42*a*. Ball bearings 88 can be provided between the inner and outer races 84, 86 to allow for relative rotation between the inner and outer races 84, 86. A spacer can be provided at the gap 83 to allow axial load to be transferred between the inner races 84 of each of the bearing pairs to prevent skewing of the bearings caused by misalignment of the inner and outer races 84, 86 and other damage. In one example, the inner races 84 of the inner bearings of each bearing pair can include inward axial extensions that contact each other and function as spacers for transferring axial load between the inner races 84 of each pair of bearings.

Figure 5:
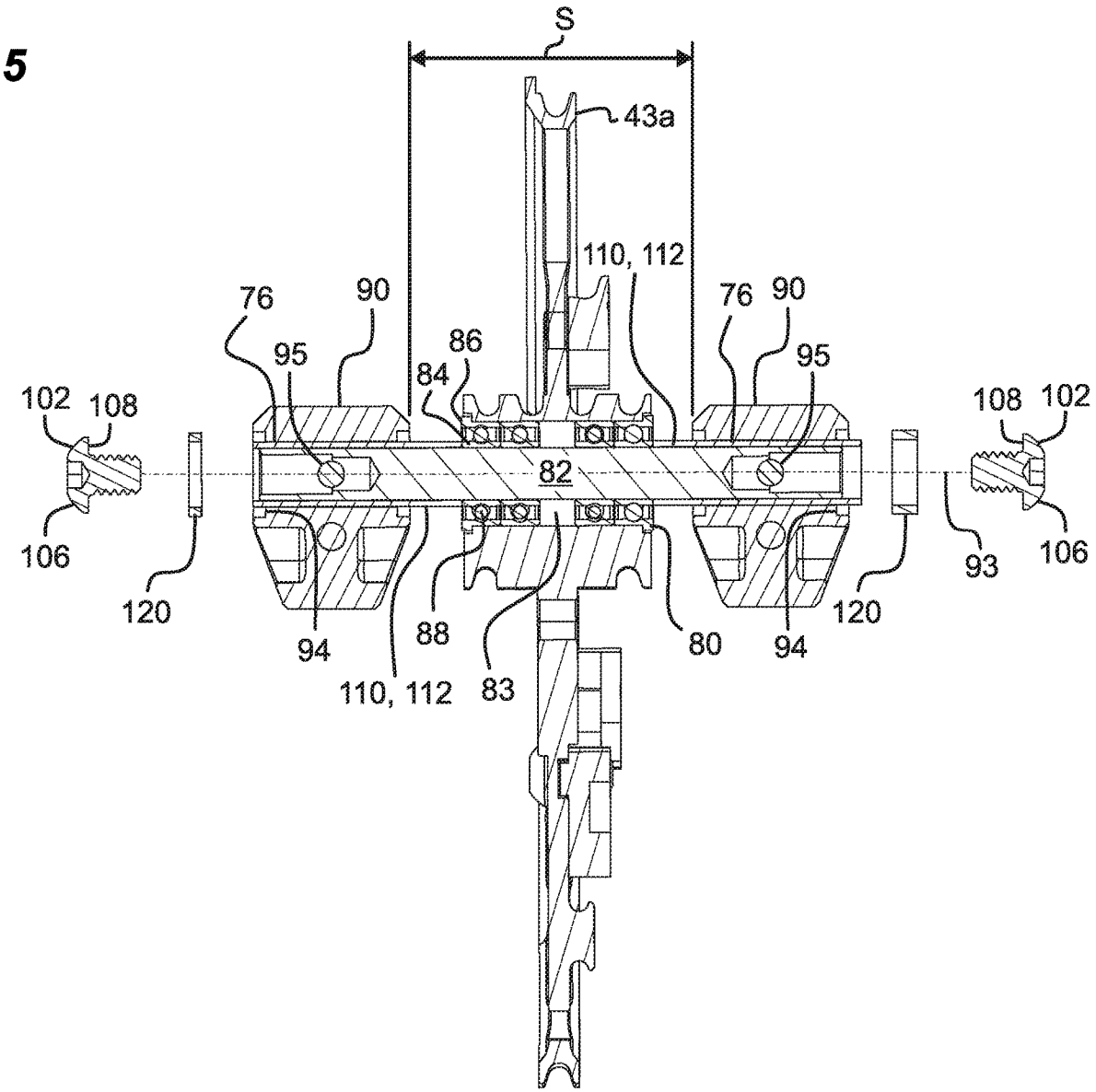
FIG. 5 is a partially exploded cross-sectional view of the cam and axle arrangement of FIG. 2 with the limb structures of the archery bow shown.
Figure 6:
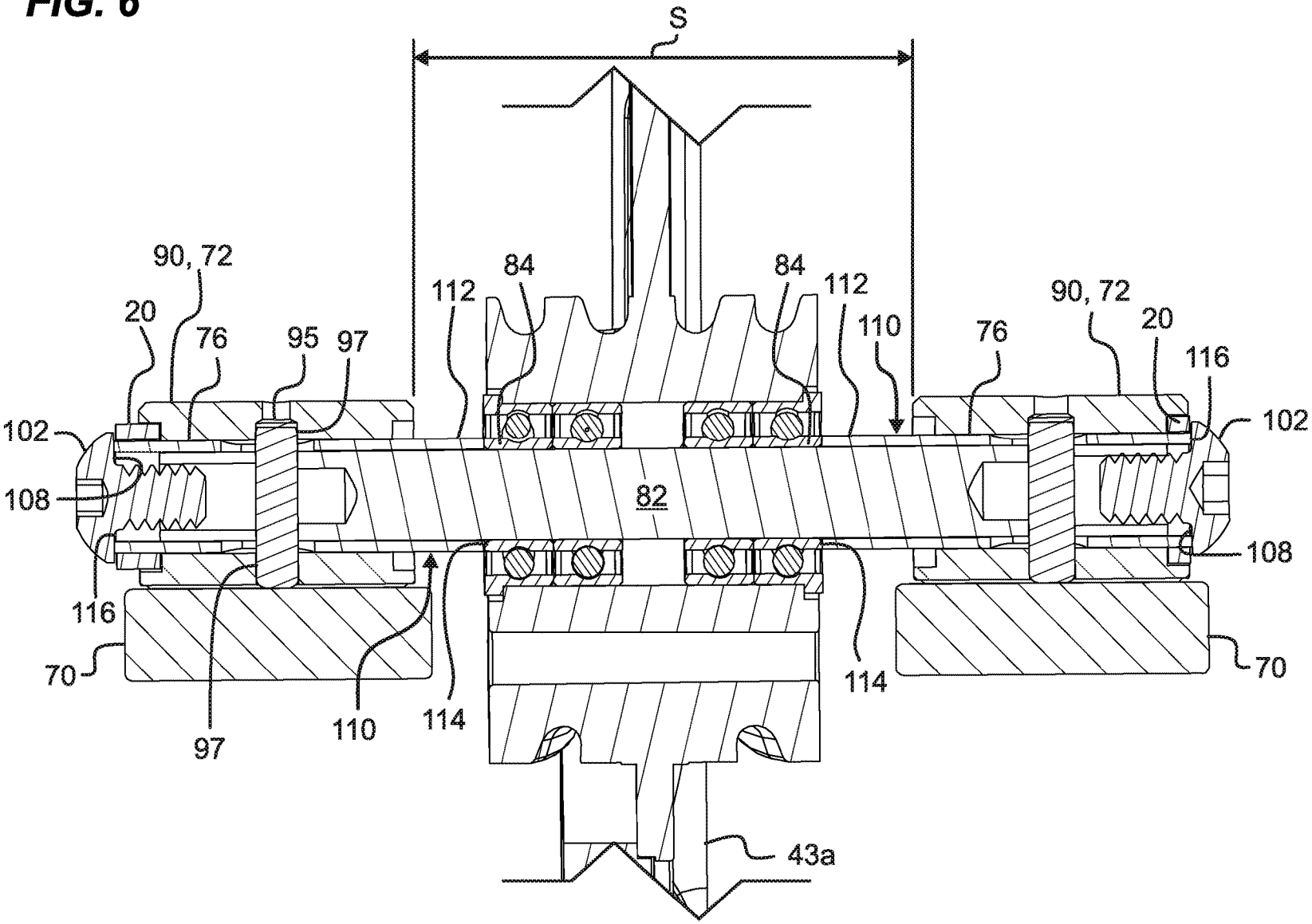
FIG. 6 is a fully assembled cross-sectional view of the cam and axle arrangement of FIG. 2 with the limb structures of the archery bow shown.

Referring to FIGS. 2-6, the upper limb arrangement 36*a* includes first and second limb structures 90 (e.g., pillow blocks 70) defining axle openings 76 aligned along an axle axis 93. When the bow 20 is assembled, the first and second limb structures 90 are spaced part from one another in an orientation along the axle axis 93 by a spacing S (see FIGS. 5 and 6). The bearings 80 mount on the axle 82 within the spacing S. The first and second limb structures 90 each include outer spacer seats 94 that face away from the spacing S. The outer spacer seats 94 can be recessed within the outer sides of the first and second limb structures 90. The axle 82 extends along the axle axis 93 through the axle openings 76. The axle 82 is secured to the first and second limb structures 90 to limit axial movement of the axle 82 relative to the first and second limb structures 90 along the axle axis 93. In one example, the axle 82 is secured to each of the first and second limb structures 90 by fasteners. The fasteners can include cross-fasteners that extend laterally (e.g., radially) through the axle 82 and engage the first and second limb structures 90. The fasteners can have ends that fit within corresponding openings defined by the first and second limb structures 90. As depicted, the fasteners can include cross pins 95 that extend laterally through cross openings 96 defined by the axle 82. As shown at FIG. 6, ends of the cross pins 95 fit within openings 97 defined by the first and second limb structures 90. When the first and second limb structures 90 are mounted to their corresponding limb members 72, the cross pins 95 are captured within the openings 97 by the limb members 72.

The axle 82 of the axle arrangement includes opposite ends 100 that as shown at FIGS. 5 and 6 are accessible at outer sides of the first and second limb structures 90 adjacent the outer spacer seats 94. Axial end fasteners 102 are adapted to be secured at the opposite ends 100 of the axle 82. The axial end fasteners 102 threadedly engage the opposite ends 100. For example, the opposite ends 100 can include internally threaded openings 104 that extend an axial direction into the axle 82, and the axial end fasteners 102 can be threaded within the internally threaded openings 104. In one example, the axial end fasteners 102 are threaded fasteners such as bolts. When the axial end fasteners 102 are threaded within the internally threaded openings 104, the axial end fasteners 102 align with the axle axis 93. The axial end fasteners 102 include fastener heads 106 including stop surfaces 108 that face in an inward direction (e.g., toward the outer spacer seats 94, the axle ends 100, and the spacing S as shown at FIGS. 5 and 6).

Bearing positioning sleeves 110 of the axle arrangement are provided for positioning the bearings 80 and the corresponding cam 42*a* at a desired axial position within the spacing S. It will be appreciated that depending upon the archer, the position of the bearings 80 and the corresponding cam 42*a* can be varied. For example, it may be desired for the cam 42*a* to be centered within the spacing S, to be offset toward the left limb structure 90 within the spacing S, or to be offset toward the right limb structure 90 within the spacing S. It will be appreciated that axle arrangements in accordance with the principles of the present disclosure allow the archer to adjust the cam 42*a* to a desired location within the spacing S (e.g., by selecting and installing the appropriate spacers at outer sides of the limb structures 90, as described below) without requiring the axle 82 to be removed/detached from the limb structures 90.

The bearing positioning sleeves 110 mount on the axle 82 and extend through the axle openings 76. The bearing positioning sleeves 110 are adjustable axially along the axle axes 93 relative to the axle 82 and the first and second limb structures 90. The bearing positioning sleeves 110 have inner portions 112 that project inwardly into the spacing S between the first and second limb structures 90. Inner ends 114 of the bearing positioning sleeves 110 oppose the inner races 84 of the outer bearings 80. By adjusting the distance the bearing positioning sleeves 110 project into the spacing S, the axial position of the bearings 80 and the cam 42*a* within the spacing S can be adjusted. Outer ends 116 of the sleeves 110 oppose and contact the stop surfaces 108 of the axial end fasteners 102. In this way, the stop surfaces 108 function to limit/stop outward movement of the sleeves 110 within the axle openings 76. By adjusting the axial positions of the stop surfaces 108 (e.g., by threading the axial end fasteners 102 in or out of the corresponding ends of the axle 82), the distance the inner portions 112 of the bearing positioning sleeves 110 project into the spacing S can be adjusted. In this way, the stop surfaces 108 of the axial end fasteners 102 can be used to set the inward projection distances that the bearing positioning sleeves 110 project into the spacing S.

The axle arrangement also includes spacers 120 for precisely setting/establishing axial positions of the stop surfaces 108 of the axial end fasteners 102. The spacers 120 mount over outer ends of the bearing positioning sleeves 110 adjacent outer sides of the limb structures 90. The bearing positioning sleeves 110 extend through the spacers 120. The spacers 120 have openings defining inner diameters that receive the outer ends of the bearing positioning sleeves 110. The bearing positioning sleeves 110 have outer diameters that are preferably slightly smaller than the inner diameters of the spacers 120. The spacers 120 preferably mount at outer sides of the limb structures 90 adjacent the outer spacer seats 94. In certain examples, the outer sides of the limb structures 90 are recessed for receiving the spacers 120. When the axle arrangement is assembled, the spacers 120 are axially compressed between the stop surfaces 108 of the axial end fasteners 102 and the outer spacer seats 94. Contact between the stop surfaces 108 of the axial end fasteners 102 and the spacers 120 stops inward axial movement of the axial end fasteners 102 to establish axial positions of the stop surfaces 108 relative to the limb structures 90. It will be appreciated that since the outer ends 116 of the bearing positioning sleeves 110 abut against the stop surfaces 108, the axial positions of the stop surfaces 108 (which are positioned to align with the outer surfaces of the spacers 120) control/determine the distance the bearing positioning sleeves 110 project into the spacing S. It will be appreciated that inner radial portions of the stop surfaces 108 oppose the outer ends of the bearing positioning sleeves 110 and outer radial portions of the stop surfaces 108 overlap and oppose the outer sides of the spacers 120. When the axial end fasteners 102 are secured to the opposite ends 100 of the axle 82, axial thicknesses of the spacers 120 determine axial positions of the stop surfaces 108 along the axle axis 93 relative to the first and second limb structures 90 thereby determining the inward projection distances that the bearing positioning sleeves 110 project into the spacing S.

The bearing positioning sleeves 110 define pass-through openings 125 through which the cross pins 95 extend. The pass-through openings 125 are elongate in an axial orientation along the axle axis 93 to allow the bearing positioning sleeves 110 to be moveable relative to the axle 82 along the axle axis 93. The pass-through openings 125 have axial lengths, and a range of axial movement of the bearing positioning sleeves 110 relative to the axle 82 is defined by the axial lengths of the pass-through openings 125.

It will be appreciated that the axial thicknesses of the spacers 120 determines the positioning of the cam 42*a* within the spacing S. If the spacers 120 have the same axial thickness, the cam 42 a will be centered within the spacing S. If the spacer 120 adjacent the left limb structure 90 is axially thinner than the spacer 120 adjacent the right limb structure 90, the cam 42*a* will be offset toward the right limb structure 90 within the spacing S. If the spacing 120 adjacent the left limb structure 90 is axially thicker than the spacer 120 adjacent the right limb structure 90, the cam 42*a* will be offset toward the left limb structure 90 within the spacing S. The thicker the thickness of the spacer 120, the further the stop surface 108 of the axial end fastener 102 is outwardly offset from the corresponding limb structure 90. Since the outer end of each bearing positioning sleeve 110 abuts against and is stopped by a corresponding stop surface 108, the distance the inner portion of each bearing positioning sleeve 110 projects into the spacing S is inversely related to the distance the corresponding stop surface 108 is outwardly offset from the corresponding limb structure 90 by the corresponding spacer 120.

The spacers 120 can be provided in sets of spacers with each set of spaces including two spacers. For example, FIG. 3 depicts the axle arrangement including three spacer sets 122A-122C. The spacer sets 122A-122C can provide spacers 120 with different axial thicknesses for allowing positioning of the cam 42*a* to be tuned within the spacing by selecting the suitable spacer set. The spacers 120 of each spacer set 122A-122C preferably define the same total axial thickness (e.g., the first and second spacers of each spacer set define a total axial thickness with the total axial thickness of each of the spacer sets being the same). The total axial thickness is preferably sized to minimize open space within the spacing S and to minimize the amount of possible axial movement of the bearings 80 axially on the axle 82. Additionally, the total axial thickness is preferably sized to inhibit the likelihood of excessive axial compression of the bearings 80 when the fasteners 102 are tightened. It will be appreciated that the first and second spacers of the spacer set 122A have different axial thicknesses than one another. Similarly, the first and second spacers of the spacer set 122C have different axial thicknesses than one another and different axial thicknesses than the first and second spacers of the spacer set 122A. When tuning the bow, the spacer set corresponding to the desired cam offset from a center of the spacing can be established by selecting the spacer set with the appropriate individual spacer axial thicknesses. To provide more precise fine tuning of the offset, additional spacer sets having additional individual thicknesses can be provided. The spacer set 122B has first and second spacers with the same individual axial thickness. The spacer set 122B can be selected if it is desired to center the cam 42*a* within the spacing S.

To assemble the axle arrangement, the bearings 80 and the cam 42*a* are loaded onto the axle 82. The bearing positioning sleeves 110 are then inserted axially over the opposite ends 100 of the axle 82. The bearing positioning sleeves 110 are preferably rotationally positioned such that the pass-through openings 125 of the bearing positioning sleeves 110 align with the cross openings 96 defined by the axle 82. The pillow blocks 72 (e.g., the first and second limb structures 90) are then inserted axially over the bearing positioning sleeves 110 positioned on the axle 82. The openings 97 of the pillow blocks 72 are aligned with the cross openings 96 and the through openings 125. The cross pins 95 are then inserted into the openings 97 of the pillow blocks 72 and through the cross openings 96 of the axle 92 (e.g., to axially fix the axle 92 relative to the pillow blocks 72) and through the through-openings 125 of the bearing positioning sleeves 110 (e.g., to limit the range of axial movement of the bearing positioning sleeve 110 relative to the axle 82 and the pillow blocks). The pillow blocks 72 are then secured to the limb members 70 with block fasteners 73 thereby capturing/trapping the cross pins 95 within the openings 97. Based on a desired positioning of the cam 42*a* within the spacing S, one of the spacer sets 122A-122C can be selected and the corresponding spacers 120 inserted over the outer ends of the bearing positioning sleeves 110 in alignment with the spacer seats 94. If an offset is desired, a spacer set having first and second spacers 120 with different axial thicknesses corresponding to the desired offset distance can be selected and installed. The thicker of the first and second spacers is installed on the side of the axle arrangement toward which an offset is desired, and the thinner of the first and second spacers is installed on the opposite side of the axle arrangement. Once the spacers 120 have been positioned on the outer ends of the bearing positioning sleeves 110, the axial end fasteners 102 are threaded into the threaded ends 100 of the axle 82 until the spacers 120 are compressed between the stop surfaces 108 of the axial end fasteners 102 and the spacer seats 94. Upon compression of the spacers 120, the stop surfaces 108 are precisely positioned to achieve a positioning of the bearing positioning sleeves 110 that corresponds to the desired positioning of the bearings 80 and the cam 42*a*. If it is desired to change the positioning of the cam 40*a* within the spacing S, this can be achieved without requiring removal of the axle 82 from the limb arrangement 36*a* by simply removing the axial end fasteners 102 from the ends of the axle 82 (e.g., by unthreading the fasteners 102) replacing the previously assembled spacers 120 with new spacers 120 corresponding to the desired positioning of the cam 40*a*, and reinstalling the axial end fasteners 102 in the ends of the axle 82 to compress the new spacers 120 against the spacer seat 94.

In should be appreciated the above description is not meant to be limiting. The above description relates to several embodiments of the invention. Many other embodiments are possible.

What is claimed is:

1. An archery bow comprising:

a riser having upper and lower ends;

upper and lower limb arrangements respectively coupled to upper and lower ends of the riser, each of the upper and lower limb arrangements including first and second limb structures, the first and second limb structures of each of the upper and lower limb arrangements defining axle openings aligned along an axle axis, the first and second limb structures of each of the upper and lower limb arrangements being spaced apart from one another in an orientation along the axle axis by a spacing, the first and second limb structures of each of the upper and lower limb arrangements including outer spacer seats that face away from the spacing;

axles that extend along the axle axes through the axle openings, the axles being secured to their corresponding first and second limb structures to limit axial movement of the axles relative to the first and second limb structures along the axle axes, the axles including opposite ends;

bearings mounted on the axles, the bearings being positioned within the spacings between each of the first and second limb structures;

cams mounted on the bearings;

axial end fasteners that threadedly engage the opposite ends of the axles and that axially align with the axles, the axial end fasteners including fastener heads including stop surfaces that face toward the outer spacer seats;

bearing positioning sleeves that mount on the axles and extend through the axle openings, the bearing positioning sleeves having inner portions that project inwardly into the spacings between the first and second limb structures, wherein the stop surfaces of the axial end fasteners are used to set inward projection distances that the bearing positioning sleeves project into the spacings, the bearing positioning sleeves being adjustable axially along the axle axes relative to the axle and the first and second limb structures; and spacers through which the bearing positioning sleeves extend, the spacers being axially compressed between the stop surfaces of the axial end fasteners and the outer spacer seats, wherein when the axial end fasteners are secured to the opposite ends of the axles, axial thicknesses of the spacers determine axial positions of the stop surfaces along the axle axes relative to the first and second limb structures thereby determining the inward projection distances that the bearing positioning sleeves project into the spacings.

2. The archery bow of claim 1, wherein the spacers of each of the upper and lower limb arrangements include first and second spacers, and wherein the first spacers have a first axial thickness and the second spacers have a second axial thickness, and wherein the first and second axial thicknesses have different magnitudes.

3. The archery bow of claim 1, further comprising radial fasteners that extend radially through the axles for limiting movement of the axles relative to the first and second limb structures along the axle axes.

4. The archery bow of claim 3, wherein the bearing positioning sleeves define pass-through openings through which the radial fasteners extend, the pass-through openings being elongate in axial orientations along the axle axes to allow the bearing positioning sleeves to be moveable relative to the axles along the axle axes.

5. The archery bow of claim 4, wherein the pass-through openings have axial lengths, and wherein a range of axial movement of the bearing positioning sleeves relative to the axles is defined by the axial lengths of the pass-through openings.

6. The archery bow of claim 5, wherein the first and second limb structures are pillow blocks, wherein the upper and lower limb arrangements each include first and second limb members, wherein the pillow blocks are secured to the limb members by block fasteners, and wherein the radial fasteners are pins having ends that engage the pillow blocks.

7. The archery bow of claim 1, wherein the bearings include inner races that surround the axles and outer races on which the cams are mounted, and wherein inner ends of the bearing positioning sleeves oppose the inner races.

8. The archery bow of claim 1, wherein the opposite ends of the axles define internally threaded axial openings, and wherein the axial end fasteners thread within the internally threaded axial openings.

9. The archery bow of claim 2, further comprising third and fourth spacers respectively having third and fourth axial thicknesses that are different from each other and that are different from the first and second axial thicknesses, wherein the third and fourth spacers can be substituted for the first and second spacers to adjust a spacing of the bearings between the first and second limb structures, and wherein a sum of the first and second axial thicknesses equals a sum of the third and fourth axial thicknesses.

10. The archery bow of claim 9, wherein the third and fourth spacers can be substituted for the first and second spacers without requiring the axles to be removed from the axle openings and without requiring bearing positioning sleeves to be removed from the axle openings.

11. A cam arrangement adapted to be mounted to first and second limb structures of an archery bow, the cam arrangement comprising:

an axle that extends along an axle axis, the axle including opposite internally threaded ends, the axle defining axle securement openings that extend laterally through the axle;

axle fasteners adapted to extend through the axle securement openings for securing the axle relative to the first and second limb structures;

at least one bearing that mounts on the axle;

a cam that mounts on the at least one bearing;

axial end fasteners adapted to be threaded into the internally threaded ends of the axle in axial alignment with the axle, the axial end fasteners including fastener heads including stop surfaces that face toward the internally threaded ends of the axle;

bearing positioning sleeves that mount on the axle, the bearing positioning sleeves being adjustable axially along the axle axis relative to the axle, the bearing positioning sleeves having inner portions adapted to project inwardly into a spacing between the first and second limb structures, wherein the stop surfaces of the axial end fasteners oppose outer ends of the bearing positioning sleeves and are used to set inward projection distances that the bearing positioning sleeves project into the spacing; and spacers adapted to mount over the bearing positioning sleeves at outer sides of the first and second limb structures, the spacers being configured to be radially overlapped by the stop surfaces of the axial end fasteners such that the spacers are axially compressed between the stop surfaces of the axial end fasteners and the first and second limb structures when the cam arrangement is mounted to the first and second limb structures, wherein when the axial end fasteners are secured to the opposite ends of the axle axial thicknesses of the spacers determine axial positions of the stop surfaces along the axle axis relative to the first and second limb structures thereby determining the inward projection distances that the bearing positioning sleeves project into the spacing.

12. The cam arrangement of claim 11, wherein the spacers include first and second spacers, and wherein the first spacer has a first axial thickness and the second spacer has a second axial thickness, and wherein the first and second axial thicknesses have different magnitudes.

13. The cam arrangement of claim 11, wherein the spacers include first and second spacers, and wherein the first spacer has a first axial thickness and the second spacer has a second axial thickness, and wherein the first and second axial thicknesses have the same magnitudes.

14. The cam arrangement of claim 11, wherein the axle fasteners extend laterally through the axle, wherein the bearing positioning sleeves define pass-through openings through which the axle fasteners laterally extend, the pass-through openings being elongate in an axial orientation along the axle axis to allow the bearing positioning sleeves to be moveable relative to the axle along the axle axis.

15. The cam arrangement of claim 14, wherein the pass-through openings have axial lengths, and wherein a range of axial movement of the bearing positioning sleeves relative to the axle is defined by the axial lengths of the pass-through openings.

16. The cam arrangement of claim 11, wherein the spacers include first and second spacers, wherein the first spacer has a first axial thickness and the second spacer has a second axial thickness, wherein the cam arrangement further comprises third and fourth spacers respectively having third and fourth axial thicknesses that are different from each other and that are different from the first and second axial thicknesses, wherein the third and fourth spacers can be substituted for the first and second spacers and wherein a sum of the first and second axial thicknesses equals a sum of the third and fourth axial thicknesses.

17. A spacer and axle arrangement for a cam of an archery bow, the spacer and axle arrangement comprising:

an axle that extends along an axle axis, the axle including opposite internally threaded ends, the axle defining axle securement openings that extend laterally through the axle;

axle fasteners adapted to extend through the axle securement openings;

axial end fasteners adapted to be threaded into the internally threaded ends of the axle in axial alignment with the axle, the axial end fasteners including fastener heads including stop surfaces that face toward the internally threaded ends of the axle;

bearing positioning sleeves that mount on the axle, the bearing positioning sleeves being adjustable axially along the axle axis relative to the axle, the bearing positioning sleeves having outer ends adapted to be opposed by the stop surfaces of the axial end fasteners, the bearing positioning sleeves defining pass-through openings through which the axle fasteners are adapted to laterally extend, the pass-through openings being elongate in an axial orientation along the axle axis to allow the bearing positioning sleeves to be moveable relative to the axle along the axle axis; and spacers adapted to mount over the bearing positioning sleeves, the spacers being configured to be radially overlapped by the stop surfaces of the axial end fasteners.

18. The spacer and axle arrangement of claim 17, wherein the pass-through openings have axial lengths, and wherein a range of axial movement of the bearing positioning sleeves relative to the axle is defined by the axial lengths of the pass-through openings.

19. The spacer and axle arrangement of claim 17, wherein the spacers include first and second spacers, and wherein the first spacer has a first axial thickness and the second spacer has a second axial thickness, and wherein the first and second axial thicknesses have different magnitudes.

20. The spacer and axle arrangement of claim 17, wherein the spacers include first and second spacers, wherein the first spacer has a first axial thickness and the second spacer has a second axial thickness, wherein the spacer and axle arrangement further comprises third and fourth spacers respectively having third and fourth axial thicknesses that are different from each other and that are different from the first and second axial thicknesses, wherein the third and fourth spacers can be substituted for the first and second spacers and wherein a sum of the first and second axial thicknesses equals a sum of the third and fourth axial thicknesses.

* * * * *